US005410758A

United States Patent [19]

Dupont et al.

[11] Patent Number: 5,410,758

[45] Date of Patent: May 2, 1995

[54] PROTECTIVE GARMENT HAVING RETAINING BAG

[75] Inventors: Pam Dupont; Debra Benoit, both of Houma, La.

[73] Assignee: Embellished Uniforms, Houma, La.

[21] Appl. No.: 151,915

[22] Filed: Nov. 15, 1993

[51] Int. Cl.[6] ..... A41D 13/12

[52] U.S. Cl. ..... 2/51; 2/94; 2/247; 2/901

[58] Field of Search ..... 2/69, 94, 901, 46, 51, 2/69.5, 247, DIG. 1, 48, 52, 85, 87, 108, 114

[56] References Cited

U.S. PATENT DOCUMENTS

| | | | |
|---|---|---|---|
| 601,489 | 3/1898 | Tim | 2/DIG. 1 |
| 4,171,542 | 10/1979 | Cox et al. | 2/247 |
| 4,404,689 | 9/1983 | DeWan | 2/94 |
| 4,476,587 | 10/1984 | Itoi | 2/94 |
| 4,637,075 | 1/1987 | Ingrisano et al. | 2/51 |
| 4,700,409 | 10/1987 | DeLott | 2/94 |
| 5,001,785 | 3/1991 | Heiman et al. | 2/51 |
| 5,010,592 | 4/1991 | Skiles, Jr. | 2/247 |
| 5,159,718 | 11/1992 | Moyer | 2/93 |
| 5,271,100 | 12/1993 | Holt | 2/51 |

FOREIGN PATENT DOCUMENTS

| | | | |
|---|---|---|---|
| 8006134 | 6/1982 | Netherlands | 2/94 |

OTHER PUBLICATIONS

Gershman, Maurice "Self Adhering Nylon Tapes," *Journal of AMA,* vol. 168, No. 7, Oct. 18, 1958.

*Primary Examiner*—Andrew M. Falik
*Assistant Examiner*—Amy B. Vanatta
*Attorney, Agent, or Firm*—Keaty & Keaty

[57] ABSTRACT

A resuable protective garment for covering at least an upper torso of the user. The garment is formed from fluid repellent material and is provided with a retaining bag fixedly secured to the interior surface of the front panel for receiving a folded contaminated garment and enclosing the garment therein. The non-detachable retaining bag is made from a contrasting color from the remainder of the garment to allow easy identification of contamination. The garment can be used as a teaching tool for explaining universal precautions observed when using protective clothing in a hazardous environment.

11 Claims, 4 Drawing Sheets

PROTECTIVE GARMENT HAVING RETAINING BAG

BACKGROUND OF THE INVENTION

This invention relates to articles of clothing, and more particularly to protective clothing adapted to be worn in places wherein the user needs protection against occupational hazards such as exposure to blood and other potentially infectious agents which might splash on user's clothes and/or be absorbed by his skin. Even more particularly, the present invention relates to the protective garments which can find broad application in health care industry and in work environments where the employee may come into contact with materials which are biohazardous.

Protective garments have long been in use in health care facilities, funeral homes, chemical industry facilities and other work stations. The main purpose of the garments is to protect the skin and clothing of the user from the harmful effects of occupational exposure to blood, other infectious agents and bio hazardous materials. Paper disposable coats and cloth lab coats utilized in health care facilities, chemical laboratories and the like suffer from the same major disadvantage: they are expensive, increase environmental hazardous waste and in the case of cloth lab coats absorb rather than repel harmful fluids. The present invention has been specifically designed for but not limited to the specified use of a protective garment as outlined in OSHA's Title 29 Code of Federal Regulations 1910.1030 (effective date for compliance of Personal Protective Equipment—Jul. 6, 1992), which states "Personal protective equipment must not allow blood or other potentially infectious material to pass through to worker's clothing, skin, or mucous membrane."

Additional problems often encountered with the use of disposable garments is a sheer bulk of disposable waste which must be treated in accordance with rigid safety regulations. As a result, there exists a need for a protective garment which would provide a true fluid barrier to harmful substances and which can be cleaned for subsequent reusal instead of disposal after the original contamination.

The present invention, therefore, contemplates provision of a protective garment which can provide a barrier to harmful fluids and which can be cleaned a number of times.

SUMMARY OF THE INVENTION

It is an object of the present invention to provide a protective garment which insures a fluid barrier against harmful substances that might penetrate to the clothing or skin of the user.

It is another object of the present invention to provide a protective garment which can be cleaned and reused a number of times instead of being disposed of immediately after initial contamination.

It is a further object of the present invention to provide a protective garment which has safety means for containing a soiled garment prior to cleaning.

It is still a further object of the present invention to provide a protective garment which is comfortable to the user in a variety of environments.

It is still a further object of the present invention to provide a protective garment which is easy to don and is inexpensive to manufacture.

It is still a further object of the present invention to provide a protective garment that can be used as an educational tool to teach workers the methods of using universal safety precautions.

These and other objects of the present invention are achieved through a provision of a protective garment which comprises a fluid repellent front panel which is sized and shaped to cover at least an upper torso of the user. A pair of fluid repellent back panels is fixedly attached along side seams to the front panel and can be secured together in the back through the use of one or more sets of fasteners having hook and loop material attached thereto. One of the embodiments contemplates provision of a protective garment having a completely closed back and overlapping back panels, while another embodiment provides for non-engaging back panels which form a discreet gap between the free edges of the back panels. A pair of ventilating inserts are fitted between the side seams of the panels and the sleeve portions, the ventilated panels being made from an open mesh material.

The free ends of the sleeves are provided with stretchable woven cuffs which tightly enclose the wrists of the user, eliminating the danger of scratching the user's skin and ensuring that no contamination penetrates the arms of the user. Universal safety precautions demand that gloves also be worn for protection covering the ribbed cuff, although such gloves form no part of the present invention. A similar tightly fitting stretchable woven collar is attached to the front panel and the back panels around the neck opening.

One of the most important features of the present invention is a non-detachable retaining bag fixedly attached to an interior surface of the front panel, the bag having an opening allowing the contaminated garment to be folded and inverted into the retaining bag. A flap is provided for closing the bag alerting other personnel that the garment is contaminated and not usable. The retaining bag, similarly to the remainder of the garment, is formed from a fluid repellent material but has a contrasting color, so that service personnel can easily identify a soiled garment folded into the bag. It also allows for an accurate accountability of the soiled garments before sending to the laundry. The garment can be washed and reused a number of times without losing its repellent properties.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Turning now to the drawings in more detail, numeral 10 designates the protective garment in accordance with the present invention. The protective garment 10 comprises a front panel 12 and a pair of back panels 14 and 16. The front panel 12 covers at least an upper torso of the user and extends from the neck area to a level below the waist of the user. Depending on safety requirements, the gown can extend to the hips of the user or even below the knees.

Figure 1:
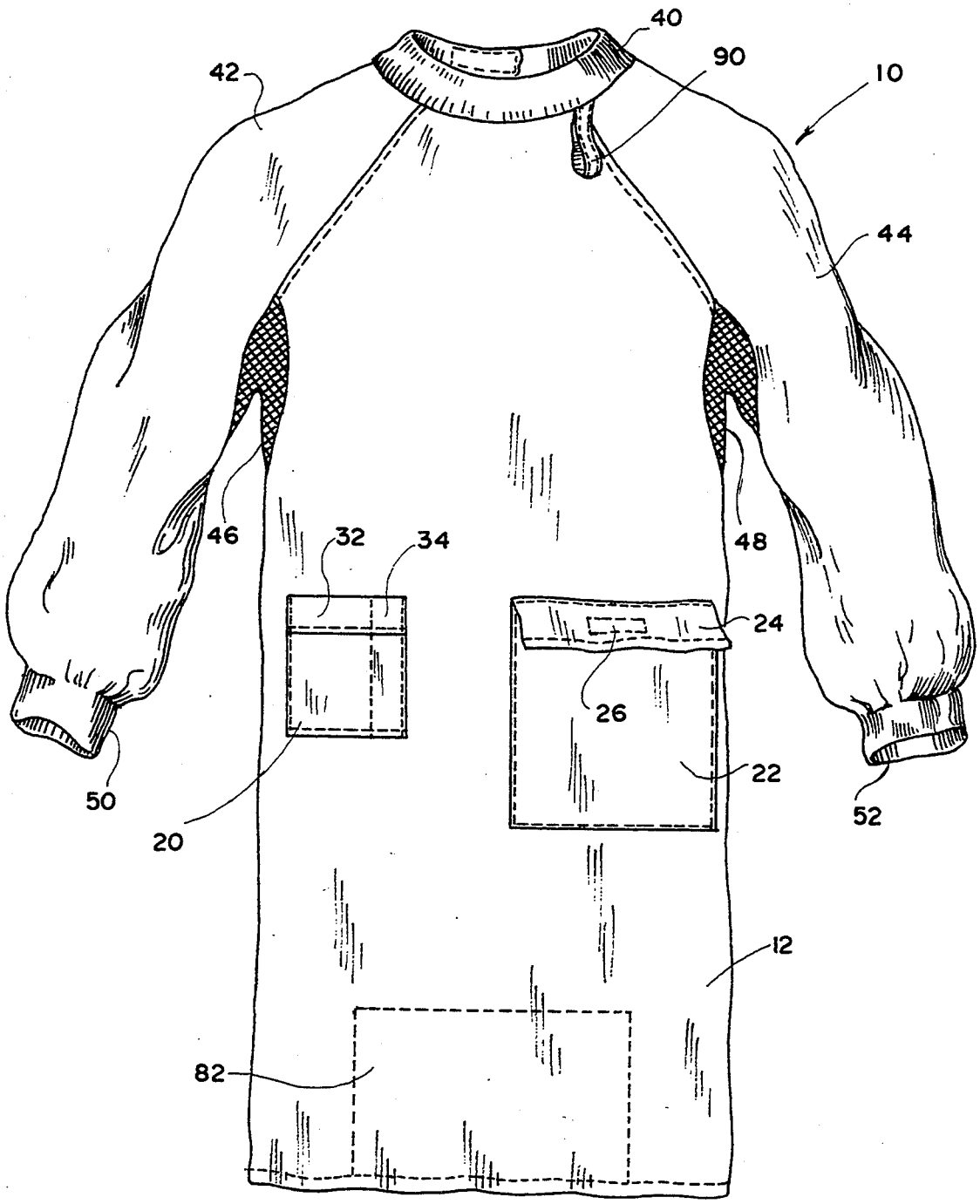
FIG. 1 is a perspective view of the front of the protective garment in accordance with the present invention.

Securely attached to the front panel 12 are a pair of pockets 20 and 22. The pocket 20 is the work side adapted to retain pens, small lights and other articles often required on the job. This pocket may become contaminated as the articles are used in procedures. Pocket 22 is adapted to retain additional work gloves. Flap 24, provided on the pocket 22, and an exterior surface 30 of the pocket 22 are provided with matching strips of hook and loop fasteners (only strip 26 is shown in FIG. 1 ). When the flap 24 is in its folded position, with the fasteners 26 and 28 engaging each other, no fluid contamination can drop or splash into the interior of the pocket 22, thereby protecting the clean gloves from contamination. The pocket 22 is known as the "clean side". The pockets 20 and 22 allow easy access to the required articles without the need for the user to reach under the protective garment 10 to inner pockets, thereby eliminating the danger of contamination of the user's regular work clothes.

If desired, the pocket 20 can be divided into a number of compartments 32 and 34, so as to conveniently accommodate various size articles in their individual compartments. The top of the garment 10 is provided with a stretchable woven collar 40 which can be made from, for example cotton lycra. This material is soft, does not irritate the neck of the user during long term wearing, while stretching to the desired width depending on the size of the user's neck and retaining its shape after continuous washings.

A pair of sleeve portions 42 and 44 are attached to the front panel 12 and back panels 14 and 16. The sleeves 42 and 44 are secured along the shoulder lines to the panels 12, 14 and 16 with flat felled seams, and are fitted with mesh inserts 46 and 48 to facilitate ventilation of the user. The inserts 46 and 48 are made from a material having large openings and strong enough to withstand repeated use of the garment 10, and washing and cleaning of the garment. The sleeve portions 42 and 44 are provided with stretchable woven cuffs 50 and 52, respectively, which are formed from the same material as the collar 40.

Figure 2:
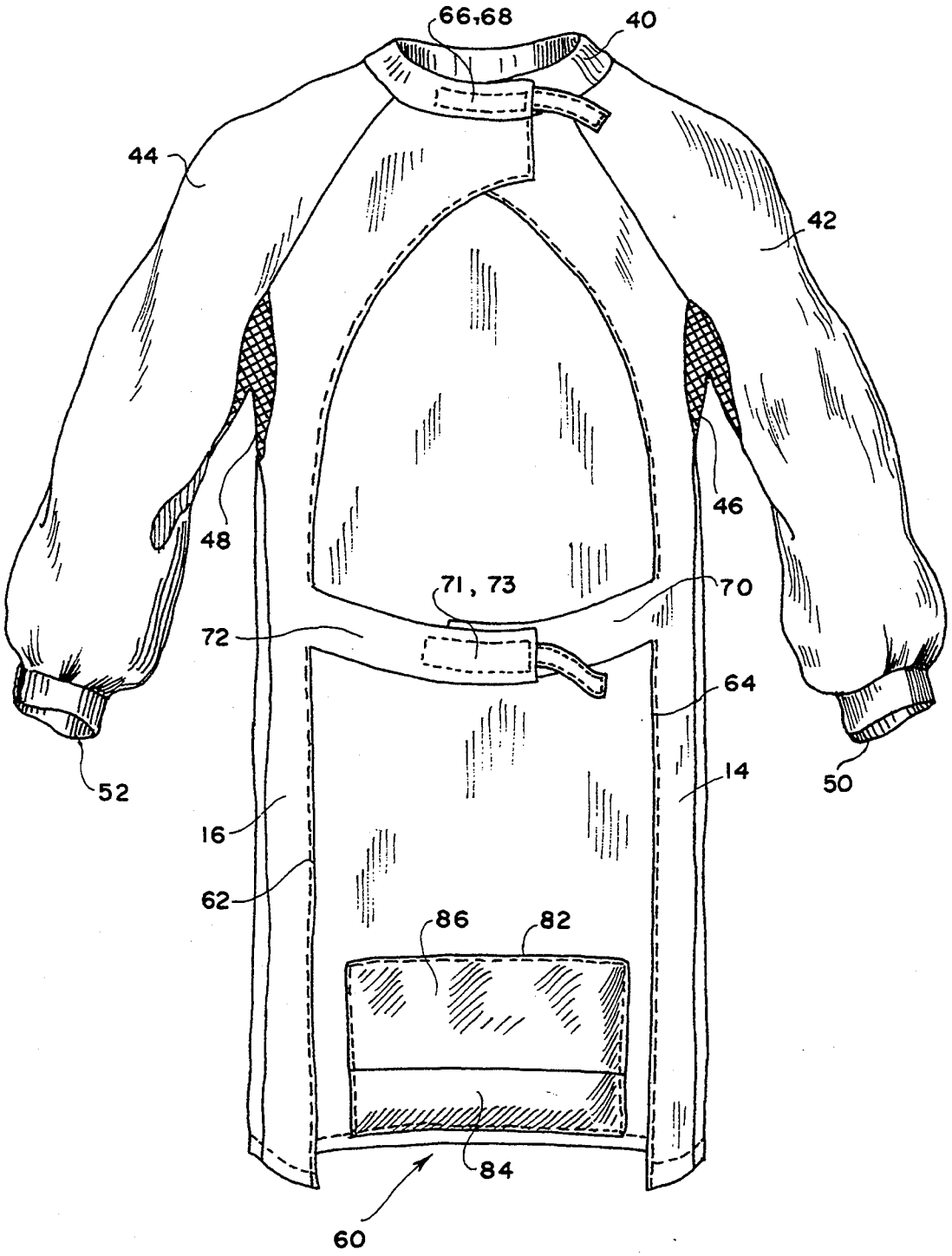
FIG. 2 is a perspective view of the protective garment in accordance with the present invention having an open back.
Figure 3:
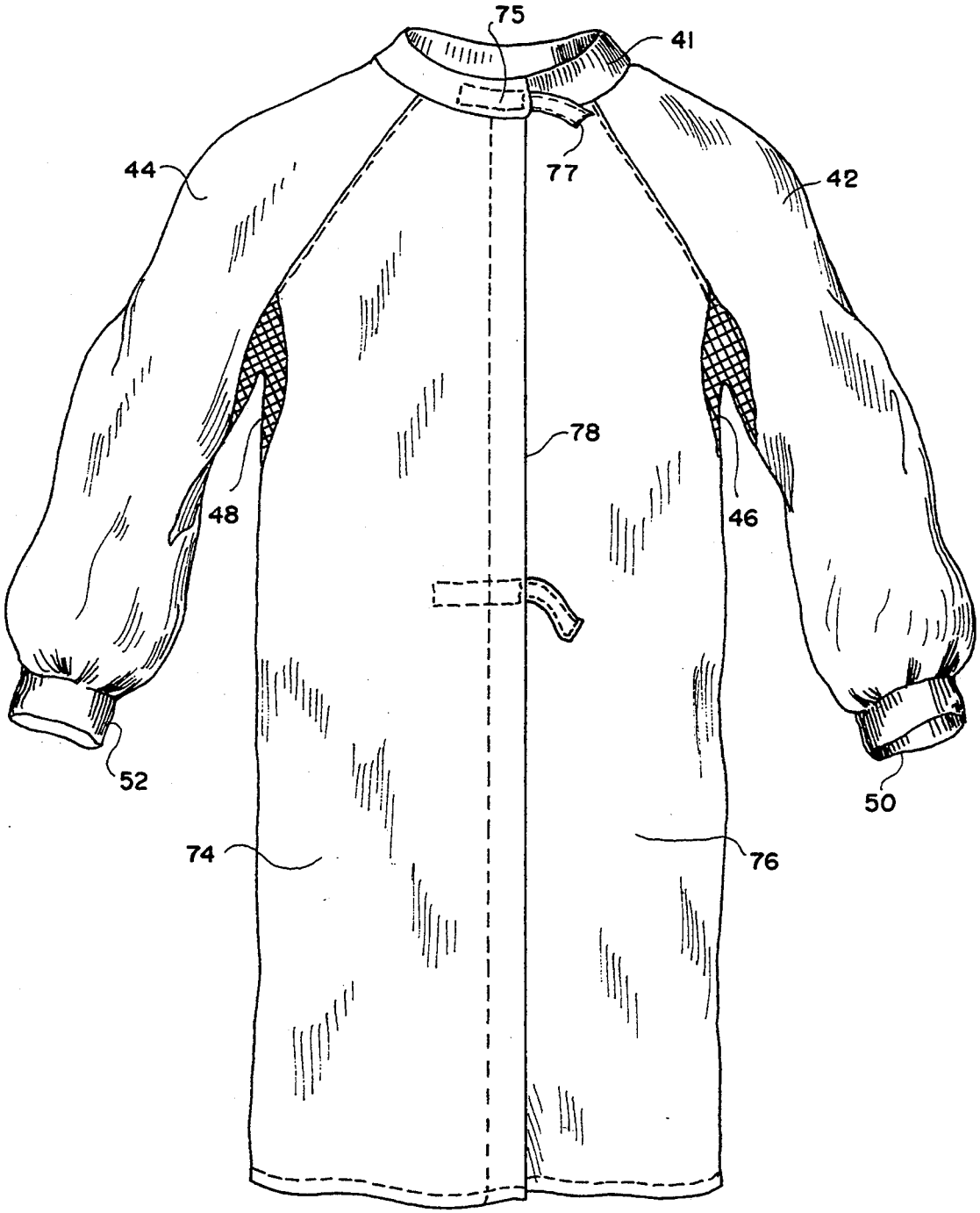
FIG. 3 is a perspective view of another embodiment of the garment in accordance with the present invention having a closed back.

Turning now to FIGS. 2 and 3, alternative embodiments of the back panels are illustrated. The embodiment of FIG. 2 shows an open back style, wherein a gap 60 is formed between the innermost edges 62 and 64 of the panels 16 and 14, respectively. The open back embodiment can be used in the environments, wherein no danger exists that the back of the user will be contaminated. The gap 60 further facilitates ventilation and makes the garment more comfortable for the user.

To secure the back panels 14 and 16 in a relatively closed position, a pair of elongated fasteners 66 and 68 are attached where the edges of the collar 40 meet in an overlapping fashion. Fasteners 66 and 68, being conveniently provided with hook and loop material, make it easier for the user to fasten the garment and provide for quick disrobing when contamination occurs. In contrast, conventionally used garments contain ties which bind, knot and are restrictive.

Another pair of securing strips 70 and 72 is attached to the back panels 14 and 16 at a hip level of the garment. The securing strips 70 and 72 can also be provided with strips of hook and loop fastening material which makes closing of these fasteners easier, as well. Provision of the hook and loop fasteners shortens the time necessary to secure the garment on the user and can be done by the user himself. In comparison with conventional garments wherein string fasteners have to be tied in the back, the fasteners of the present invention save time in the donning of the garment.

The embodiment of FIG. 3 shows an alternative embodiment with a closed back having a pair of back flaps 74 and 76 which are designed to completely enclose the back of the user. This type of garment can be useful in the environment, wherein the back of the user must be protected, as well. For example, in funeral homes the embalmer often works in a room, wherein several embalming tables are located, and wherein work is being performed at the same time on more than one body. In such a case, there is always a danger of accidental contamination of the back of the operator and it is preferred that the protective garment enclose the torso of the user in its entirety.

Similarly to the embodiment of FIG. 2, a number of fasteners are provided on the back panels 74 and 76, the fasteners being concealed by the edge 78 which overlaps the panel 76. The fasteners are positioned on the inner surface of the panel 74 perpendicular to the edge 78 and on the matching exterior surface of the panel 76. One or more fastener sets can be provided for closing the garment shown in FIG. 3 another such set is provided on the collar 41, the set comprising a long strip 75 of the hook and loop material having an extra length as at 77, which allows self mating during agitation in laundering.

Secured to the lower portion of the garment 10, on the inner surface 80 of the front panel 12, is a retaining pocket, or bag 82 which comprises a reversible elongated bag panel 84 and a flap 86. It is preferred that the retaining bag 82 be formed from a material having a contrasting color to that of the remainder of the garment 10 for the reasons which will become apparent hereinafter.

Figure 4:
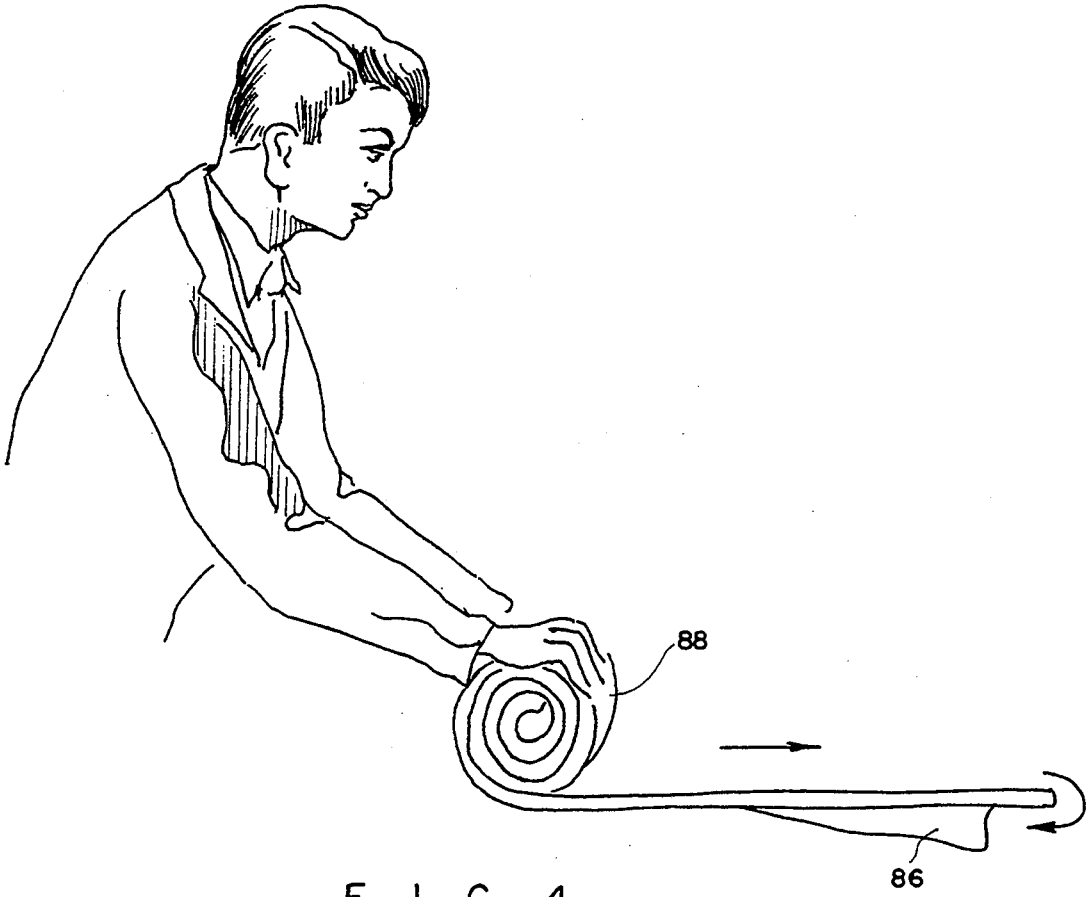
FIG. 4 is a schematic view illustrating a manner of folding the protective garment before positioning it in the retaining bag.
Figure 5:
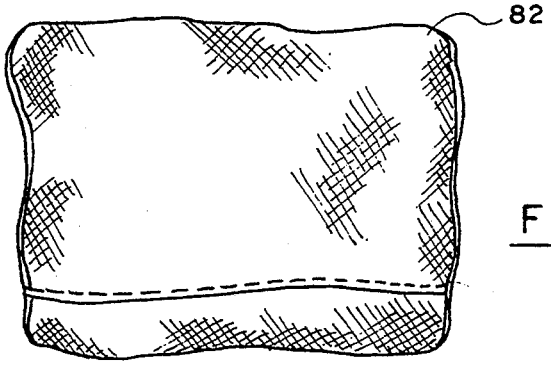
FIG. 5 is a perspective view illustrating the retaining bag with the protective garment enclosed therein.

When the garment 10 becomes soiled or contaminated, it is necessary to fold it in some manner for transportation to a cleaning facility or to a laundry. The user then takes off the garment, while observing universal precautions of turning the sleeves inside out and reversing the exterior surface of the garment to the inside. In this manner, the retaining bag 82 will appear on the outside of the garment 10, thus keeping all contaminates on the inside. The user then rolls the garment starting from the neck portion, moving downwardly through the panels 12, 14 and 16, until the entire length of the garment is rolled up into a roll 88, as shown in FIG. 4. Additionally, the wearer helps others, such as laundry workers who will handle the contaminated garment. Through the rolling process the wearer can feel for any sharp objects such as needles which may have been left in the pockets. This is a big source of accidents within facilities when garments are merely taken off and tossed haphazardly into a large laundry container. The process of rolling the garment makes the wearer more alert for items left in the pockets, thus reducing a major area of risk for laundry personnel who are often accidentally punctured when sorting and handling contaminated laundry. This process of rolling the garment makes the wearer responsible for removing equipment left in the garment before it reaches the laundry personnel. The flap 86 is lifted and the roll 88 is fitted within the bag 82. Once the roll 88 is inside, the flap 86 is reversed to close the opening through which the roll 88 was fitted into the bag 82. The folded soiled garment is then completely enclosed within the bag 82. The garment is not taken out of the bag 82 until it reaches the laundry facility. At that time the laundry personnel clothed in protective equipment as well, pop it out of the pouch before washing. The bag is designed to open the garment upside down, so that any equipment overlooked by the wearer can fall out further decreasing risk to laundry personnel.

Since the bag 82 is attached to the interior surface 80 of the panel 12, no contamination has penetrated inside the bag 82, and it is safer to handle the bag 82 in its folded condition with the garment 10 completely encased as opposed to a loose, non-contained, contaminated garment. Individual bags 82 can then be placed into a storage container for subsequent transportation to a laundry or other cleaning facility. They are easy to count and the service personnel can always make sure that the number of gowns which have been dispensed to the laundry matches the number of gowns returned to the user's department. If desired, a name tag tab 90 can be easily attached to the exterior surface of the garment 10, and the garment be assigned to a particular user. Various size garments can be manufactured to accommodate different size people who will need the garment. All soiled or contaminated garments are self contained in their own color-coded bags. This feature helps to decrease risk of exposure among workers.

Figure 6:
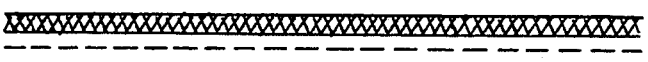
FIG. 6 is a schematic diagram showing flat felled seams utilized in the area of the connection of the front panel and back two panels to the sleeve portions to ensure that no contamination penetrates under the garment in the sleeve area.

The garment 10 can be manufactured from a number of fluid repellent type materials. One such example is a material sold under trade-name "Ripstop Nylon", manufactured by Radice Automatica S.P.A. of Italy. Tests conducted by a company which engages in the testing of textiles demonstrated that the garment 10 manufactured from "Ripstop Nylon" material maintains 90% of its repellant qualities after 50 commercial washings. At the same time, small spots or spills can be wiped with alcohol, until the garment must be cleaned in its entirety. To prevent contamination through the seams, the present invention utilizes a flat felled seam design where the front panel 12 and back panels 14 and 16 are joined by the sleeve 42 and 44. This is the high risk area for possible contamination. The seam design is shown in a schematic diagram of FIG. 6.

The location of the pockets 20 and 22 can be changed, moving the pockets higher or lower on the front panel depending on the particular requirements of the industry, where the garment 10 is to be used. If desired, a fabric loop can be attached to the upper portion of the garment to allow hanging of the garment when not in use. It is preferred that the fasteners 66 and 71 which are made of the hook component of the closure also have attached to one end of a tab made of the loop component material. This tab is anchored to either the proximal or the distal end of the hook fastener. The opposite end of the loop tab is left free. The purpose of the free loop tab is to allow self-mating of the free end of the tab to the hook component of the fastener. This feature prevents the hook component of the fastener to attach itself to other areas of the garment, lint or other items during laundering of the garment, thus prolonging the life of the garment.

Many other changes and modifications can be made within the design of the present invention without departing from the spirit thereof. We, therefore, pray that our rights to the present invention be limited only by the scope of the appended claims.

We claim:

1. A reusable protective garment, comprising;

a fluid repellent front panel sized and shaped to cover at least an upper torso of a user;

first and second fluid repellent back panels fixedly attached along side seams to the front panel and adapted for detachable fastening to each other;

means for detachably securing free edges of the back panels, said securing means comprising at least one elongated fastener attached to a collar portion of the first back panel, an inner surface of the fastener and a collar portion of the second back panel being provided with discrete strips of matching hook and loop fastening material, the length of said elongated fastener being greater than a length of the strip of the fastening material secured to the second back panel, so as to allow self-mating of the elongated fastener when the garment is being cleaned, said collar portions carrying a stretchable woven collar;

a pair of fluid repellent sleeve portions, said sleeve portions being provided with stretchable woven cuffs; and a fluid repellent retaining bag fixedly attached to a lower interior surface of the front panel, said bag comprising a reversible bag panel and a flap secured along opposite sides to corresponding sides of the bag panel, said flap having an unsecured side which extends horizontally across entire length of the bag panel, said bag receiving and retaining a contaminated folded protective garment when the bag and the flap are turned inside out, thereby preventing exposure of contaminated surfaces of the garment.

2. The garment of claim 1, wherein said securing means further comprises a pair of lower fasteners provided with matching hook and loop fastening elements.

3. The garment of claim 1, wherein exterior surface of said front panel is provided with at least one pocket and a flap closing said pocket, and wherein engaging surfaces of the pocket and the flap each have a discreet strip of matching hook and look fastening material.

4. The garment of claim 1, further comprising ventilated panels fitted between the sleeve portions and the side seams.

5. The garment of claim 4, wherein said ventilated panels are made from an open mesh material.

6. The garment of claim 1, wherein said retaining bag is formed from a material having a contrasting color in relation to the remainder of the garment, so as to alert personnel of the presence of a contaminated garment retained in the bag.

7. A protective garment, comprising:

a fluid repellent front panel sized and shaped to cover at least an upper torso of a user;

a pair of fluid repellent back panels fixedly attached along side seams to the front panel and adapted for detachable fastening to each other;

means for securing free edges of the back panels, said securing means comprising at least one elongated fastener attached to a collar portion of one back panel, an inner surface of the fastener and a corresponding exterior surface of a collar portion of the second back panel being provided with matching hook and loop fastening elements, wherein said elongated fastener has a length greater than a length of the corresponding fastening element, so as to allow self-mating of the elongated fastener when the garment is being cleaned;

a pair of fluid repellent sleeve portions, each of said sleeve portions having a stretchable woven cuff secured to a free end thereof;

ventilated panels fitted between the sleeve portions and the side seams, said ventilated panels being formed from an open mesh material; and a fluid repellent retaining bag fixedly attached horizontally to a lower inner surface of the front panel, said bag receiving a contaminated folded protective garment, said bag comprising a reversible elongated bag panel and a flap covering at least a portion of the bag panel, said flap having one unsecured side which extends horizontally across entire length of the bag panel, said flap closing the retaining bag after the bag has been turned inside out and the folded garment has been positioned therein, said bag being formed from a material having a contrasting color in relation to the remainder of the garment, so as to alert personnel of the presence of a contaminated garment retained in the bag.

8. The garment of claim 7, further comprising a stretchable woven collar secured to neck openings of the front panel and of the back panels.

9. The garment of claim 7, further comprising a lower securing means which comprises a pair of fasteners provided with strips of matching hook and loop fastening material.

10. The garment of claim 7, wherein said front panel has an exterior surface, and a pocket is attached to the exterior surface, said pocket being closable by a pocket flap.

11. The garment of claim 10, wherein engaging surfaces of the pocket and of the pocket flap are each provided with a discreet piece of matching hook and loop fastening material.

* * * * *